United States Patent [19]

Saito

[11] 4,107,947

[45] Aug. 22, 1978

[54] FINGER TIP ORNAMENT

[75] Inventor: Takashi Saito, 123 Innai-cho, Funabashi-shi, Chiba-ken, Japan

[73] Assignees: Takashi Saito, Funabashi; Takashi Ishiyama, Tokyo, both of Japan

[21] Appl. No.: 755,839

[22] Filed: Dec. 30, 1976

[30] Foreign Application Priority Data

Jan. 8, 1976 [JP] Japan ..... 51-452[U]

[51] Int. Cl.[2] ..... A44C 25/00

[52] U.S. Cl. ..... 63/2

[58] Field of Search ..... 63/1 R, DIG. 3, 2, 15; D11/27

[56] References Cited

U.S. PATENT DOCUMENTS

| | | | |
|---|---|---|---|
| 1,778,726 | 10/1930 | Pappert | 63/DIG. 3 |
| 2,346,607 | 5/1943 | Raiman | 63/15 |

FOREIGN PATENT DOCUMENTS

| | | | |
|---|---|---|---|
| 331,599 | 8/1903 | France | 63/1 R |
| 537,670 | 3/1922 | France | 63/2 |

*Primary Examiner*—F. Barry Shay

*Attorney, Agent, or Firm*—Flynn & Frishauf

[57] ABSTRACT

A finger tip ornament which can be easily attached to and removed from a finger tip comprises a plurality of C-shaped bridge members each open at the bottom and having an inner surface shape complementary to that of a cross section of a finger tip; a pair of supporting members which are connected to the respective ends of the C-shaped bridge members and extend along the finger tip toward the fingerprint portion. The furthest forward end portions of the supporting members are curved inward so as to be drawn near to each and to contact the extreme end portions of the finger tip.

13 Claims, 9 Drawing Figures

FINGER TIP ORNAMENT

BACKGROUND OF THE INVENTION

1. Field of the Invention

This invention relates to a finger tip ornament and more particularly to a finger tip ornament which carries a gem or gems to render the finger tip attractive, and which can be easily attached to and removed from the finger tips.

2. Description of the Prior Art

Fingernail polish has been applied to fingernails in attractive colors to make the finger tips look beautiful. However, nail polish has the drawbacks that much time is needed to apply same to fingernails and also allow it to dry; and a polish remover or solvent has to be used to wash off the polish material applied.

Another finger tip ornament consists of a nail decorative film (commercially known as "Tip-Top") which is pasted on fingernails. This "Tip-Top" ornament has the disadvantage that the film must be cut into an outline conforming to the shape of fingernails.

SUMMARY OF THE INVENTION

It is accordingly an object of this invention to provide a finger tip ornament which can be easily and quickly attached to and removed from finger tips.

Another object of the invention is to provide a finger tip ornament presenting a gorgeous appearance with a gem or gems mounted thereon.

Still another object of the invention is to provide a finger tip ornament which, when set in place, leaves the extreme ends of the finger tips and the fingerprint portions free and need not be taken off when it is desired to touch something.

A further object of the invention is to provide a finger tip ornament provided with means for preventing the ornament from being lost.

According to this invention, there is provided a finger tip ornament which comprises at least one C-shaped bridge member open at the bottom and having an inner surface shape substantially complementary to that of the upper portion of the finger tip; and a pair of supporting members which are fixed to the respective ends of the C-shaped bridge members and extend along both sides of the finger tip and whose extreme end portions abutting against the finger tip are curved inward so as to be drawn near to each other along the extreme end portion of the finger tip. The supporting members which are pressed against both sides of the finger tip enable the finger tip ornament to be securely mounted on the finger tip.

At least one gem may be inlaid in or mounted on at least one of the bridge members to render the finger tip attractive. The supporting members may also be fitted with a plurality of finger tip ornament-holding elements extending crosswise from the supporting member toward the fingerprint portion, thereby enabling the ornament to be attached firmly to the finger tip.

BRIEF DESCRIPTION OF THE DRAWING

This invention can be more fully understood from the following detailed description with reference to the accompanying drawings in which.

DETAILED DESCRIPTION OF THE PREFERRED EMBODIMENTS

Figure 1:
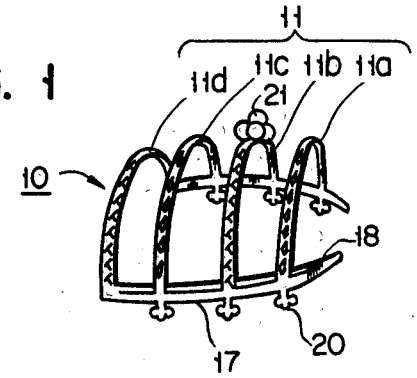
FIG. 1 is a perspective view of an embodiment of this invention.

Throughout the drawings, the same or similar parts are denoted by the same reference numerals.

A finger tip ornament generally designated at 10 is mounted on a human finger tip to render the finger tip, particularly the fingernail, attractive by a decorative design applied to the finger tip ornament itself and a gem or gems inlaid therein or mounted thereon.

Figure 2:
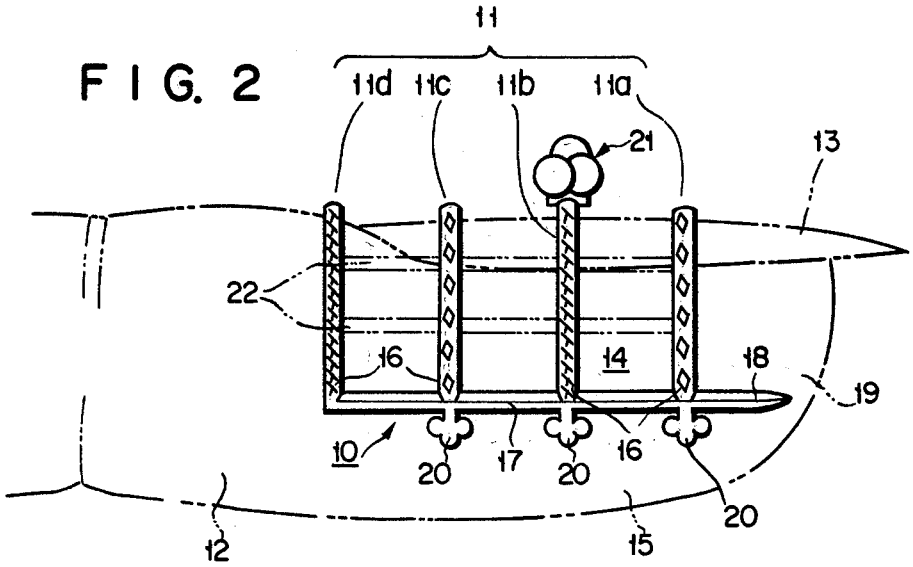
FIG. 2 is a left side elevational view of FIG. 1.
Figure 3:
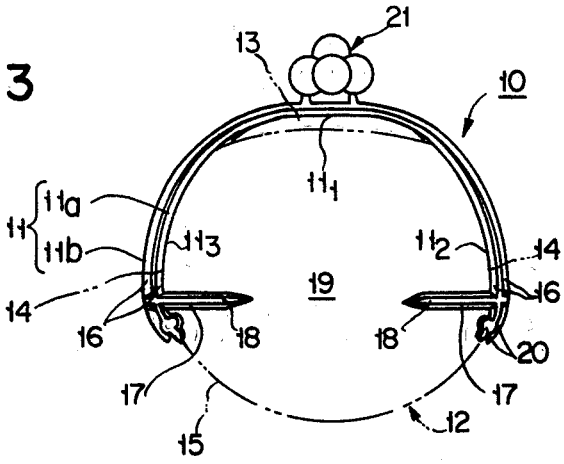
FIG. 3 is a front elevational view of FIG. 2 with two rear bridge members omitted.
Figure 4:
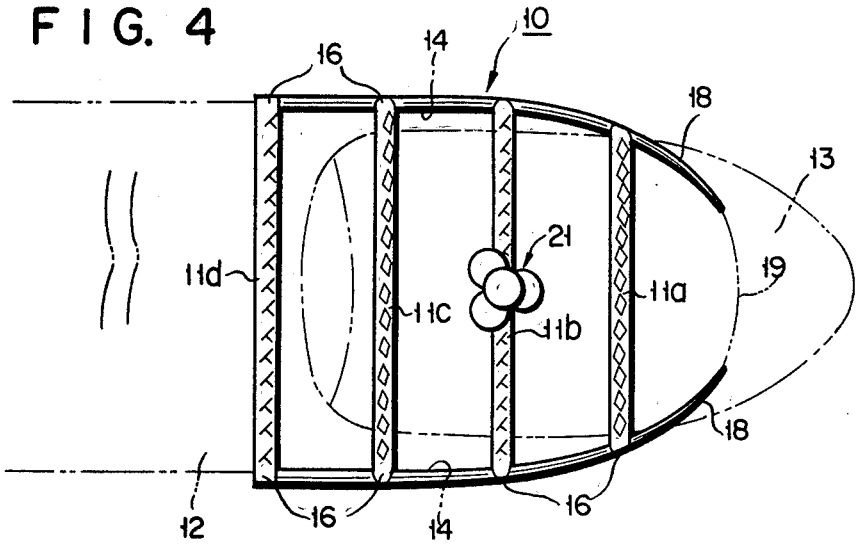
FIG. 4 is a plan view of FIG. 1

Referring to FIGS. 1 to 4, bridge members 11*a*, 11*b*, 11*c*, 11*d* (generally denoted by 11) are so fitted to the finger tip 12 as to surround it. The intermediate portion 11, (FIG. 3) of each bridge member has an inner surface shape which is substantially complementary to that of the finger tip 12 including a fingernail 13. Both end portions $\mathbf{11}_2$, $\mathbf{11}_3$ of the bridge member 11 contact both lateral sides 14 of the finger tip 12 and as seen in FIG. 2, extend to a point near the fingerprint portion (or finger cushion) 15 of the finger tip 12 substantially at right angles to the lengthwise direction of the finger tip 12. In other words, each C-shaped bridge member 11 is open at the bottom has such a shape that the inner surface of said bridge member defines a substantially complementary outline to the periphery of the finger tip cross section. The respective ends 16 of the C-shaped bridge members 11 are fixed to a pair of supporting members 17 extending along both lateral sides 14 of the finger tip 12 on the horizontal central line of the finger tip 12 or a line slightly drawn near to the fingerprint portion 15. Obviously, the bridge members 11 and supporting members 17 may be integrally formed. The paired supporting members 17 extend, as shown in FIGS. 2 to 4, along both sides 14 of the finger tip 12 while being closely pressed thereagainst. The end portions 18 of the supporting members 17 are retaining portions, and are so curved inward as to be drawn near to each other along the extreme end portion 19 of the finger tip 12 and in tight contact therewith. The above-mentioned construction of the paired supporting members 17 has the advantage that the finger tip ornament 10 is supported by the whole of both lateral sides 14 of the finger tip 12, thereby avoiding a local holding of the ornament 10 which will cause it to be insecurely set in place.

Small plate-shaped holding elements 20 project from the supporting members 17 toward the fingerprint portion 15, to hold part thereof, thereby enabling the finger tip ornament 10 even more firmly supported on the finger tip 12.

It is preferred that the bridge members 11, supporting members 17 and holding elements 20 be made of flexible metal, for example, gold or silver, or flexible plastic material. Such flexible material enables not only the finger tip ornament 10 to be nicely mounted on the finger tip 12, but also the holding elements 20 to be elastically pressed against the fingerprint portion 15 uniformly, thus assuring the secure support of the finger tip ornament 10 on the finger tip 12.

The bridge members 11 themselves have a surface which is provided with any desired design to be rendered attractive. Or it is possible to inlay or mount a gem or gems 21 such as a diamond, ruby or pearl or imitation thereof in or on at least one of the bridge members 11, thereby presenting a more beautiful ornament.

Where the finger tip ornament 10 constructed as described above is fitted to the finger tip 12, the extreme end portion 19 of the finger tip 12 and the fingerprint portion 15 are left free. Where, therefore, the extreme end portion 19 of the finger tip 12 or the fingerprint portion 15 touches on something or touches the hand of another person during a handshake or dance, the finger tip ornament 10 does not become an obstacle and need not be taken off.

It is not always necessary for the finger tip ornament 10 to be provided with a plurality of bridge members 11, but a single bridge member may be used. In this case, it is advised to cause the single bridge member to be broad and its plain surface to take any desired shape. Further, it is possible, as shown in two dots-chain lines in FIG. 2, to add additional longitudinal members 22 all over the bridge members 11 not only for increased attractiveness but also for the reinforcement of the finger tip ornament 10. Obviously, the supporting members 17 may be broader than illustrated in the drawings to attain a firmer support of the finger tip ornament 10 on the finger tip 12. In this case, the supporting members 17 may take any shape like a heart and a clover leaf, and may also be provided with a decorative pattern and/or be inlaid with gems.

Figure 5:
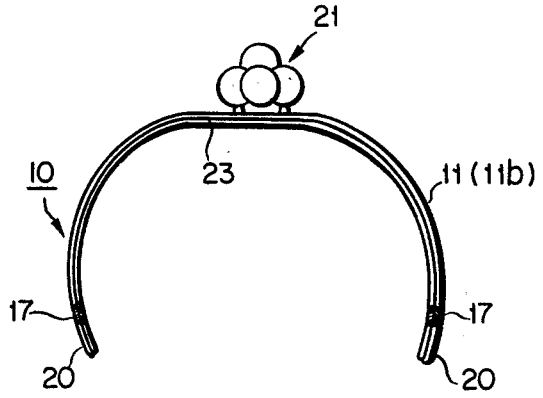
FIG. 5 is a transverse cross sectional view of another embodiment of this invention with a protective film liner on the inner surface of the bridge members, supporting member and holding elements.

According to another embodiment of this invention shown in FIG. 5, bridge members 11, supporting members 17 and holding elements 20 are lined with an elastic protective film or pad 23 such as plastic material, thereby preventing the fingernail 13, both lateral sides 14 of the finger tip 12 and fingerprint portion 15 from directly touching the metal parts of the finger tip ornament 10 for protection of the fingernail 13 and finger tip 12. The eleastic liner 23 causes the various parts of the finger tip ornament 10 to touch the fingernail 13 and finger tip 12 softly and uniformly, and further enables the ornament 10 to be more firmly mounted on the finger tip 12.

Figure 6:
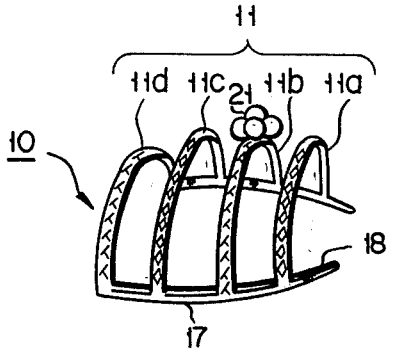
FIG. 6 is a perspective view of a further embodiment of the invention.

The embodiment of FIG. 6 is of substantially the same construction as that of FIGS. 1 to 4, except that holding elements 20 are omitted. With the embodiment of FIG. 6, only the supporting members 17 are used to mount the finger tip ornament 10 on the finger tip 12. This fitting can generally be effected simply by using the supporting members 17.

Figure 7:
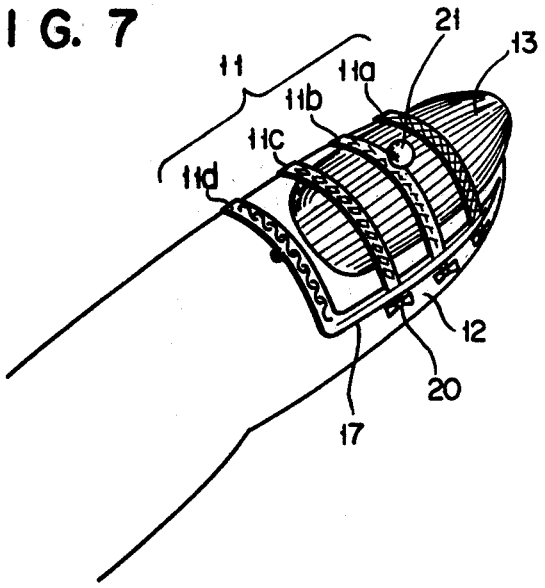
FIG. 7 is a perspective view of a still further embodiment of the invention mounted on a finger tip.

FIG. 7 shows the manner in which a finger tip ornament 10 embodying this invention is mounted on a finger tip 12. The embodiment of FIG. 7 is of substantially the same construction as that of FIGS. 1 to 4, except that only one gem is mounted; the bridge members 11 have different decorative designs and the holding elements 20 have different shapes from those shown in FIGS. 1 to 4.

Figure 8:
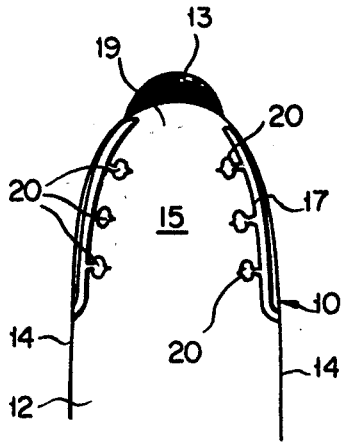
FIG. 8 is a modification of holding elements for attaching the finger tip ornament of the invention to the finger tip.
Figure 9:
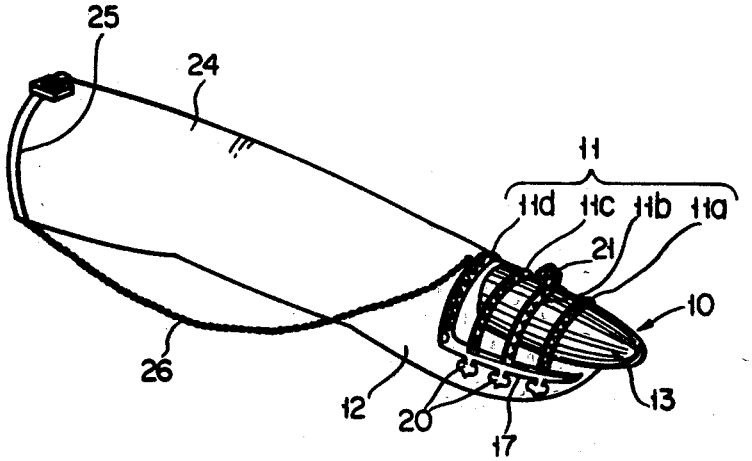
FIG. 9 is a perspective view of a still further embodiment of the invention provided with a chain member.

FIG. 8 shows the condition in which holding elements 20 are pressed against a region extending from both lateral sides 14 of the finger tip 12 to the fingerprint portion 15. It will be seen that since the holding elements 20 are bent inward, the finger tip ornament 10 does not easily come off the finger tip 12. In a further embodiment of this invention of FIG. 9, the last supporting member **11*d* of the finger tip ornament 10 and a ring 25 or any other personal item mounted on a finger 24 whose tip is fitted with said ornament 10 are connected by a chain or flexible member 26. This arrangement prevents the finger tip ornament 10 from being lost, should it come off the finger tip 12**.

With all the foregoing embodiments, it is possible to form the bridge members 11, supporting members 17 and holding elements 20 into an integral body. If, however, all these constituents of the finger tip ornament 10 are separately fabricated with required decorative designs, and later assembled, then it is possible to manufacture said constitutents in large quantities at low cost.

What is claimed is:

1. A finger tip ornament comprising:

at least one generally C-shaped bridge member open at a bottom thereof and having a non-circular inner surface shape which is substantially complementary to a non-circular surface of a finger tip, said at least one bridge member being adapted to extend around a portion of a fingertip in the transverse direction of the finger with both end portions thereof extending around the lateral sides of the finger tip, said end portions extending to and contacting points near the fingerprint portion whereby said at least one bridge member may be non-rotatably mounted on a finger;

a pair of elongated supporting members connected to respective ends of said at least one bridge member, said supporting members extending lengthwise of the finger tip and substantially perpendicular to said at least one bridge member and adapted to abut against both lateral sides of the finger in the vicinity of the finger tip, said supporting members having retaining portions at the extreme ends thereof which are adapted to be adjacent the tip of a finger, said retaining portions being curved inward towards each other so as to be drawn to each other along the extreme end portion of the finger tip to contact the end portion of the finger tip; and at least one gem mounted on said at least one bridge member.

2. The finger tip ornament of claim 1, wherein said at least one bridge member and said supporting members are lined with an elastic film for protection of a fingernail and finger tip.

3. The finger tip ornament of claim 1, further comprising plate-shaped holding elements projecting from said supporting members toward the open portion of said at least one bridge member and adapted to engage a fingerprint portion of a finger tip to hold said fingerprint portion.

4. The finger tip ornament of claim 3, wherein said at least one bridge member, said supporting members and said holding elements are lined with an elastic film for protection of a fingernail and finger tip.

5. The finger tip ornament of claim 1, wherein said supporting members extend in the direction of their lengths a substantial distance on both sides of said at least one bridge member.

6. The finger tip ornament of claim 1, comprising at least two generally C-shaped bridge members, each of which are open at the bottom thereof, each of said supporting members being commonly connected with respective ends of said at least two bridge members, at least one of said bridge members carrying said at least one gem.

7. The finger tip ornament of claim 6, wherein said bridge members have a generally part-elliptical shape so as to conform with the shape of a finger.

8. The finger tip ornament of claim 1, wherein said at least one bridge member has a generally part-elliptical shape so as to conform with the shape of a finger.

9. The finger tip ornament of claim 6, further comprising plate-shaped holding elements projecting from said supporting members toward the open portion of said at least one bridge member and adapted to engage a fingerprint portion of a finger tip to hold said fingerprint portion.

10. The finger tip ornament of claim 9, wherein said at least one bridge member, said supporting members and said holding elements are lined with an elastic film for protection of a fingernail and finger tip.

11. The finger tip ornament of claim 6, wherein said at least one bridge member and said supporting members are lined with an elastic film for protection of a fingernail and finger tip.

12. The finger tip ornament of claim 1, further comprising at least one additional longitudinal member extending generally in the same direction as said supporting members and being commonly connected to said at least one bridge member.

13. The finger tip ornament of claim 6, further comprising at least one additional longitudinal member extending generally in the same direction as said supporting members and being commonly connected to said at least two bridge members.

* * * * *